US006216418B1

(12) United States Patent
Kim

(10) Patent No.: US 6,216,418 B1
(45) Date of Patent: Apr. 17, 2001

(54) OPEN AND CLOSING APPARATUS OF HOPPER FOR AUTOMATIC TABLET SORTING AND COUNTING MACHINE

(76) Inventor: Jin Soo Kim, 224-37 Naedang-dong, Suh-gu, Daegu (KR)

( * ) Notice: Subject to any disclaimer, the term of this patent is extended or adjusted under 35 U.S.C. 154(b) by 0 days.

(21) Appl. No.: 09/353,200

(22) Filed: Jul. 14, 1999

(30) Foreign Application Priority Data

Jul. 14, 1998 (KR) ..... 98-13262

(51) Int. Cl.[7] ..... B65B 61/26
(52) U.S. Cl. ..... 53/131.5; 53/168; 53/568
(58) Field of Search ..... 53/131.5, 568, 53/168; 221/152, 236

(56) References Cited

U.S. PATENT DOCUMENTS 2,449,139 * 9/1948 Power ..... 53/131.5
4,382,527 * 5/1983 Lerner ..... 53/502
4,922,682 * 5/1990 Tait et al. ..... 53/329
5,097,652 * 3/1992 Inamura et al. ..... 53/168
5,481,855 * 1/1996 YuYama ..... 53/493
5,787,678 * 8/1998 Koike et al. ..... 53/154

* cited by examiner

*Primary Examiner*—Peter Vo
*Assistant Examiner*—Nathaniel Chukwurah
(74) *Attorney, Agent, or Firm*—John K. Park; Park & Sutton LLP

(57) ABSTRACT

A hopper opening and closing apparatus for an automatic tablet dispensing system is disclosed. The hopper opening and closing apparatus includes a door hingedly connected to a discharge hopper for swing down to open and swing up to close the release port, wherein the tablets released from the tablets dropping unit are temporarily gathered in the tablet release hopper when the release door is closed. The door is formed to cover a release port provided through a lower portion of a discharge hopper. The hopper apparatus further includes a door control, which includes a horizontal opening bar engaged at the release port, a rotation shaft driven by a motor which simultaneously drives a heat assembly, a cam carried on said rotation shaft, an opening lever making an angular movement by said cam, and an opening link engaged to the opening bar and linked from the opening lever, whereby the tablets gathered in said discharge hopper are simultaneously dropped into a target packaging paper.

10 Claims, 3 Drawing Sheets

OPEN AND CLOSING APPARATUS OF HOPPER FOR AUTOMATIC TABLET SORTING AND COUNTING MACHINE

BACKGROUND OF THE INVENTION

1. Field of Invention

The present utility model relates to a hopper opening and closing apparatus for an automatic tablet sorting and counting machine commonly referred to as "automatic tablet dispensers", and more specifically to an improved medicine hopper opening and closing apparatus for an automatic tablet dispenser which facilitates distribution of tablets dropped from a tablet dropping unit to packing paper.

2. Description of the Prior Art

Automatic tablet dispensers are generally employed in hospitals, pharmacies, and drugstores to automate the output and assembly of corresponding tablets when the prescription is input into a computer. They serve to dispense the per-dosage assembled tablets in individual single serving packages.

A conventional automatic tablet dispenser includes the following: a main computer for calculating an appropriate prescription on the basis of the type of medicine, intake method, daily intake frequency and intake duration depending upon each patient; a tablet dropping unit having a plurality of tablet cassettes and a drum for storing therein and releasing therefrom the tablets in correspondence to the prescription set up in the computer; and a packaging unit disposed below the tablet dropping unit which serves to package a quantity of tablets and release the same to an exterior of the automatic tablet dispenser.

The packaging unit is made up of: a discharge hopper for assembling the tablets being dropped from the tablet drop unit; a heater assembly for packaging the tablets being discharged through the discharge hopper; a printer for printing respective information on the packaging paper; and a release conveyer for externally discharging the medicine bags containing tablets.

The discharge hopper in the packing unit serves to temporarily store therein the tablets supplied from the tablet dropping unit and dispense a one-time intake dosage of tablets into a packaging paper having intake information printed thereon.

Conventionally, such a discharge hopper is formed in a conic shape without providing an additional opening/closing member, thereby simply serving to gather tablets from the tablet dropping unit and provide the same to a packaging paper.

In case there is provided such a discharge hopper without an opening/closing member, the time taken for tablets to reach from the tablet cassettes fixating the drum to the discharge hopper may vary due to different levels (heights) of the tablet cassettes, thereby deteriorating efficiency of tablet packaging. It also may incur some tablet loss during tablet packaging.

Since the tablet cassettes of the tablet dropping unit are provided in different levels (heights), there occurs time difference during tablet dropping. Accordingly, although the tablets are smoothly released from the tablets cassettes, a tablet loss during the packaging process prevents an accurate distribution of the tablets, thereby deteriorating reliability of the automatic tablet dispensing system.

SUMMARY OF THE INVENTION

The present utility model is contrived to overcome the conventional disadvantages. Therefore, it is an object of the present utility model to provide a hopper opening and closing apparatus for an automatic tablet sorting and counting machine, wherein the entire tablets released from the tablet dropping unit are assembled and the assembled tablets are simultaneously supplied to assigned packaging paper, thereby accomplishing a smooth packaging operation without tablet loss.

To achieve the above-described object, there is provided a hopper opening and closing apparatus for an automatic tablet sorting and counting machine according to the present utility model, which includes an opening and closing door provided at a lower portion of the discharge hopper, wherein the door remains closed when the tablets are dropping from the tablet dropping unit and the door is opened when the tablet dropping operation is completed, thereby simultaneously supplying the assembled tablets to target packaging paper.

DETAILED DESCRIPTION OF THE PREFERRED EMBODIMENTS

With reference to the accompanying drawings, the present utility model will now be described.

Figure 1:
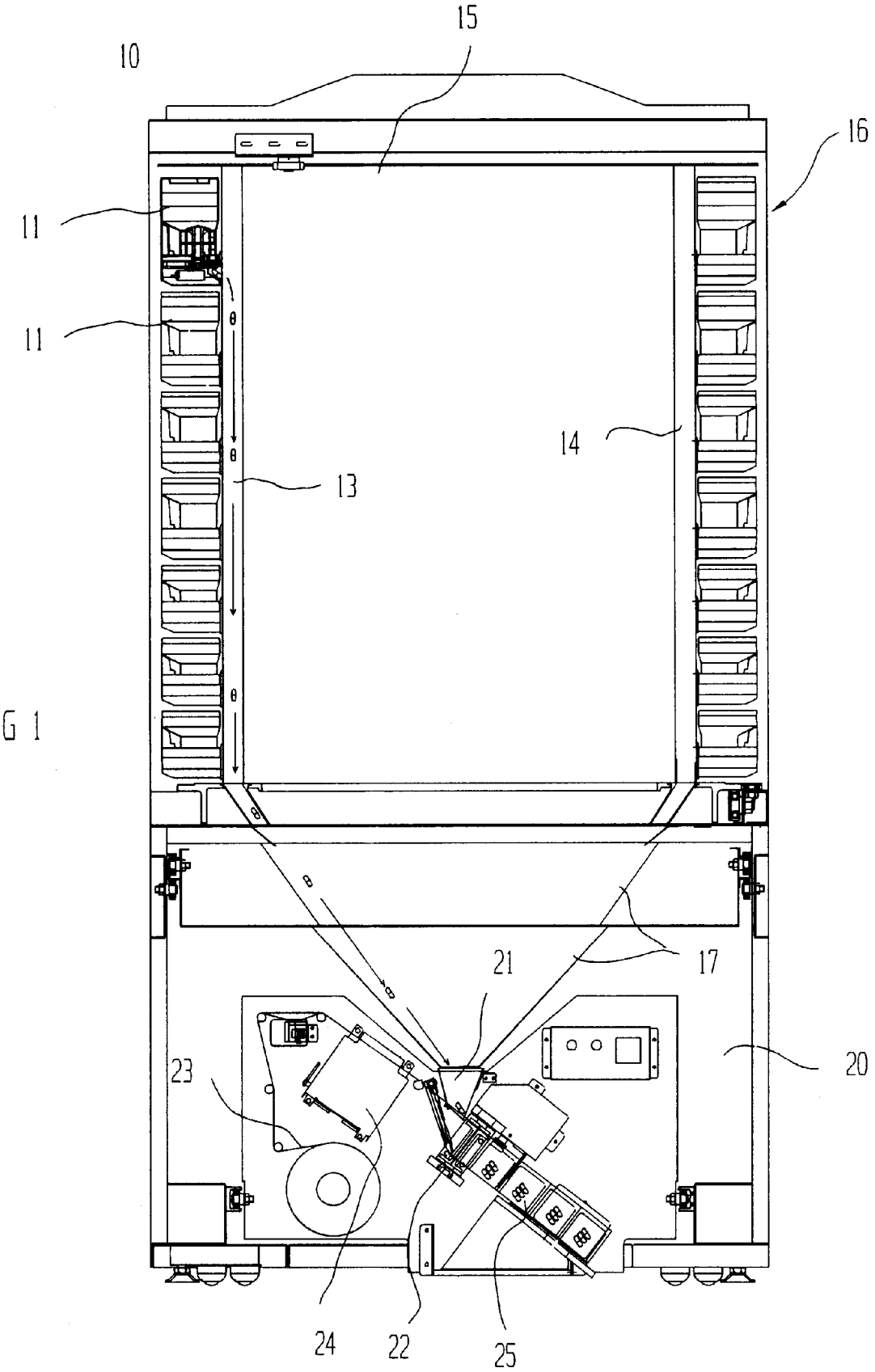
FIG. 1 is a schematic view illustrating a conventional automatic tablet dispenser with the front panel removed to show the inner components.
Figure 2:
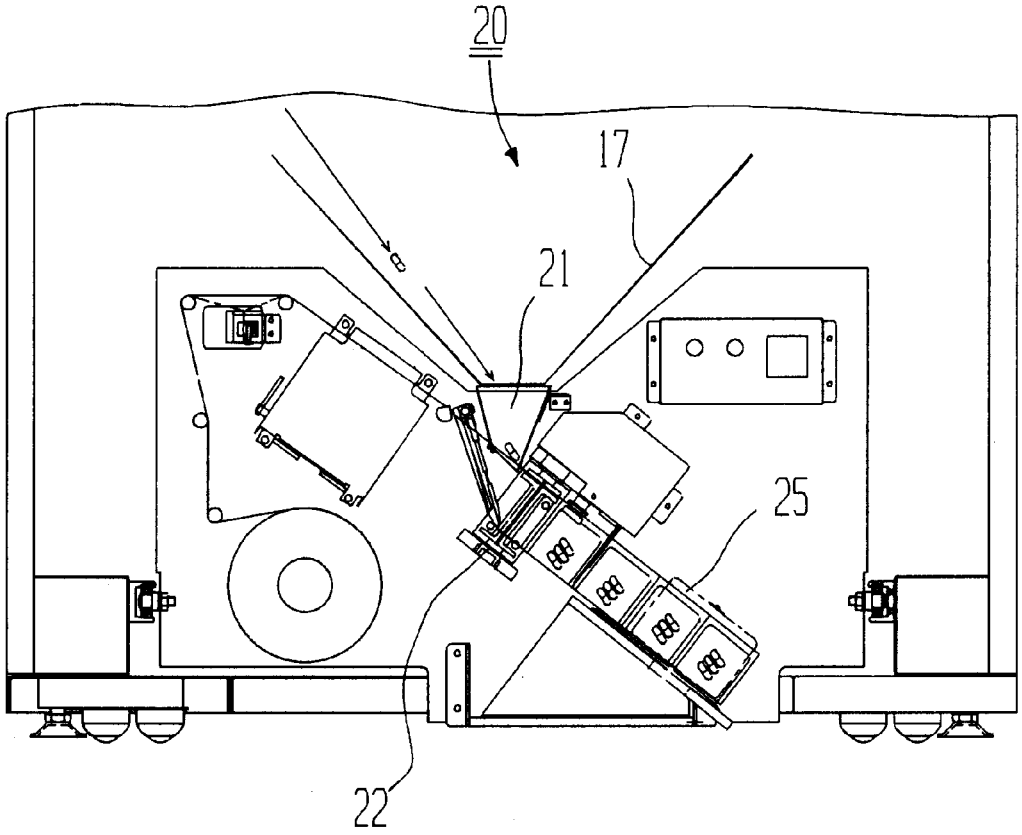
FIG. 2 is a view of a packaging unit including a discharge hopper of an automatic tablet dispenser according to the present utility model.
Figure 5:
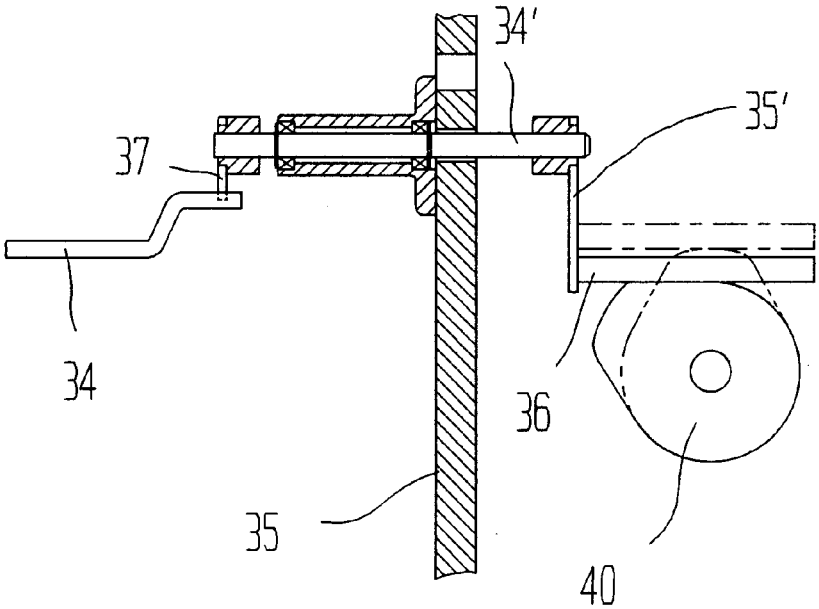
FIG. 5 is a partial cross-sectional view illustrating a door opening/closing member for an automatic tablet dispenser according to the present utility model.

As shown in FIG. 1, an automatic tablet dispenser 10 is comprised of a tablet dropping unit 16 including a cylindrical drum 15 having release holes 13, 14 engaged thereto so as to communicate a plurality of tablet cassettes 11 which respectively store tablets therein and release a measured quantity therefrom, through the outer periphery of the release holes 13, 14, so that the tablets released from the tablet cassettes 11 are dropped through the holes 13, 14.

Below the tablet dropping unit 16 there is provided a guide hopper 17 for safely guiding the tablets being released through the release holes 13, 14 so that the tablets may not be dispersed.

A packaging unit 20 is disposed below the guide hopper 17 to package and discharge the released tablets outside the automatic tablet dispenser 10.

The packaging unit 20 includes a discharge hopper 21 for gathering the tablets dropped from the tablet dropping unit 16, a heater assembly 22 for packaging the tablets released through the discharge hopper 21, a printer 24 for printing respective information on the packaging paper 23, and a discharge conveyer 25 for externally releasing the respective tablet-packaged bags.

The automatic tablet dispenser 10 is controlled by a main computer (not shown) informed of an appropriate prescription for a target patient which includes proper medicine, intake method, daily intake frequency, and intake duration.

The present utility model provides the improved discharge hopper 21 of the automatic tablet dispensing system 10, wherein a one-time dosage quantity of tablets released from the tablet dropping unit 16 comprised of the tablet cassettes 11 and the drum 15 are assembled in the discharge hopper 21 and simultaneously supplied to the packaging paper 23.

Referring to FIGS. 2 through 5, the construction and operation of the present utility model will now be explained.

A release port 30 is formed through a lower portion of the discharge hopper 21, and a door 31 is hinged to a side portion of the discharge hopper 21 by a hinge 32 using a spring 31'. Here, the door 31 remains closed.

The door 31 hingedly closed by the spring 31' may be opened using a door opening member 33 to release the assembled tablets in the discharge hopper 21.

The door opening member 33 includes an opening bar 34 horizontally engaged to the door 31. The opening bar 34 is connected by an opening link 37 to a horizontal bar 34' and a connection lever 35' which has an opening lever 36 fixed thereto, so that the angular movement of the opening lever 36 generates the opening link 37 to move. Here, the horizontal bar 34' is provided to penetrate a frame 35.

The angular movement of the opening lever 36 provided outside the frame 35 is implemented by a cam 40 carried on a rotation shaft 39 powered by a gear assembly connected to a shaft extended from a motor 38 which also serves to drive a heater assembly 22.

Specifically, a measured quantity of the tablets stored in the tablet cassettes 11 are dropped through the release holes 13, 14 fixating the drum 15 on the basis of information inputted into the main computer. The released tablets are gathered through the guide hopper 17 disposed below the drum 15 into the discharge hopper 21. The discharge hopper 21 is formed of a front panel 21*a* having a lower front panel line, a rear panel 21*b* having a lower rear panel line, and a pair of side panels 21*c* each having a lower side panel line, wherein said each panel line defines the release port 30 through a lower portion of the discharge hopper 21. The release door 31 is hingedly engaged to the lower front panel line wherein the lower front panel line is formed higher in horizontal level than the lower rear panel line, whereby the swinging operation of the release door 31 can be smoothly implemented with less momentum. The angle defined by the door 31 and the front panel 21*a* is between about 120 degrees and about 170 degrees.

When the tablets are being released from the tablet cassettes 11, the door 31 provided at the bottom portion of the discharge hopper 21 is closed. That is, the release port 30 is blocked, so that the released tablets remains gathered in the discharge hopper 21.

In case a one-time dosage of tablets are completely assembled in the discharge hopper 21, the door 31 is opened so that the assembled tablets are supplied into the packaging paper 23 therebelow so as to allow the supplied tablets to be packaged by the heater assembly 22.

With regard to the opening/closing operation of the door 31 to the release port 30, when the tablets begins releasing, the heater assembly 22, the printer 24 and the release conveyer 25 in the packaging unit 20 are simultaneously operated.

Figure 3:
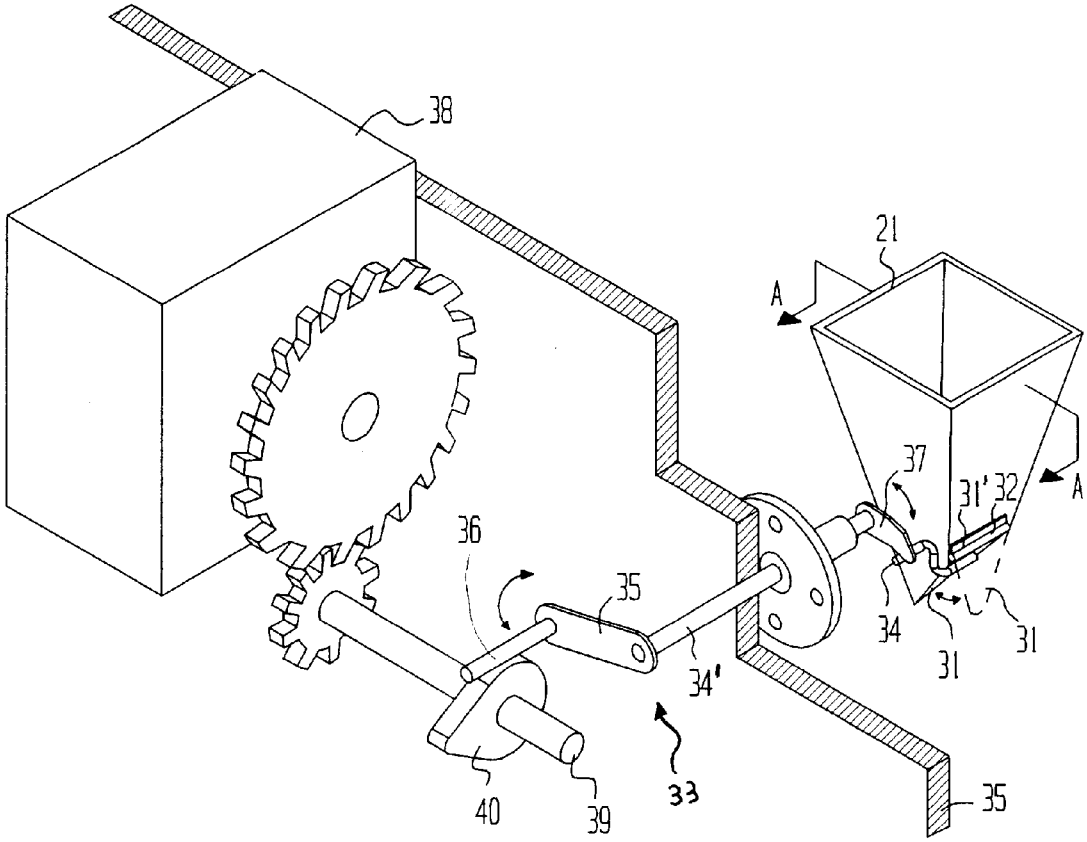
FIG. 3 is a partial perspective view illustrating a medicine hopper opening/closing apparatus for an automatic tablet dispenser according to the present utility model.
Figure 4:
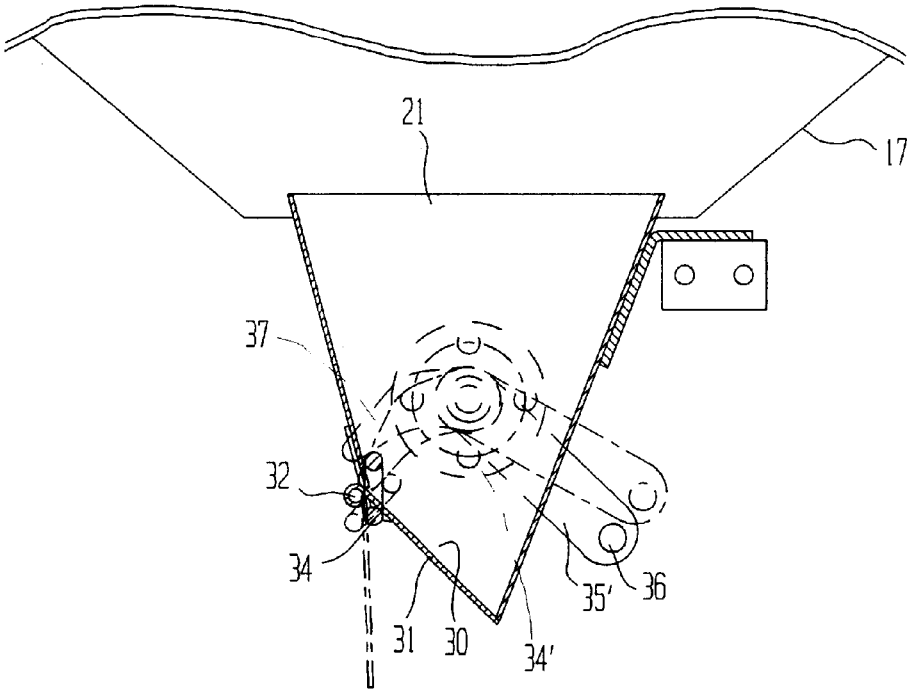
FIG. 4 is a cross-sectional view taken along line A—A in FIG. 3.

The heater assembly 22 rotates according to a bevel gear carried on the shaft extended from the motor 38 provided outside the frame 35 and at the same time pulls a portion of the packaging paper 23 so as to seal the pulled-in paper by annealing. Here, the door 31 to the discharge hopper 21 operates in correspondence to the heater assembly 22. That is, the rotation shaft 39 rotates according to the gear carried on the shaft extended from the motor 38 which also drives the heater assembly 22, and the cam 40 fixedly carried on the rotation shaft 39 generates an angular movement of the opening lever 36 so that the opening link 37 fixedly engaged to the opening lever 36 pushes the opening bar 34 fixed to the door 31, thereby opening the door 31. The opening bar 34 serves as a hinge control which bendingly extends from the hinge 32 as shown in FIG. 3. The cam 40 and hinge link 37 form a connecting member to control the swing-down (opening) of the door 31.

Although the motor 38 which drives the heater assembly 22 continues its rotation, the above operation is achieved since a turned-up point of the cam 40 carried on the rotation shaft 39 corresponds to a one-dosage sealing timing of the packaging paper 23 by the heater assembly 22.

When the heater assembly 22 seals the packaging paper 23, the door 31 remains closed by a restoring force of the spring 31'. When the heater assembly 22 has completed the sealing of the packaging paper 23, the turned-up point of the cam 40 serves to push up the opening lever 36. As a result, the opening link 37 engaged with the opening bar 34 fixed to the door 31 draws (pushes) the opening bar 34 and accordingly opens the door 31, and the assembled tablets are supplied to the packaging paper 23 therebelow.

As discussed above, the hopper opening and closing apparatus for an automatic tablet dispensing system according to the present utility model gathers therein the entire tablets released from the tablet dropping unit and simultaneously supplies the released tablets to the packaging paper, thereby enabling a smooth packaging operation without tablet loss.

What is claimed is:

1. An automatic tablet dispenser controlled by a main computer comprising:

a) a tablet dropping unit having a drum communicating with a plurality of release holes which fixate a plurality of tablet storing tablet cassettes, said release holes dropping the tablets released from the tablet cassettes;

b) a discharge hopper having a release port provided through a lower portion of said discharge hopper, and a tablet release door hingedly connected to the discharge hopper for swinging down to open and swinging up to close the release port, wherein the tablets released from the tablet dropping unit are temporarily gathered in the tablet release hopper when the release door is closed;

c) a door control for elastically controlling the swinging of the release door of the discharge hopper;

d) a heater assembly for packaging the tablets from the discharge hopper in a packaging paper; and e) a motor driving the door control and the heater assembly.

2. The automatic tablet dispenser as described in claim 1 wherein said door control comprises:

a) a hinge connecting the release door to the discharge hopper to enable the swinging of the release door thereon;

b) a spring engaged to the hinge for providing an elasticity to the swing-up (closing) operation of the release door;

c) a hinge control bendingly extending from the hinge;

d) a rotation shaft driven by the motor;

e) a cam carried on said rotation shaft;

d) a connecting member having a cam lever making an angular movement by said cam and a hinge link abutting over on the hinge control to produce the swing-down (opening) operation of the release door in accordance with the angular movement of the cam lever, whereby the tablets gathered in said discharge hopper at the swing-up operation of the release door are simultaneously dropped into a target packaging paper by the swing-down operation of the release door.

3. The automatic tablet dispenser as described in claim 1 further comprising:

a) a printer for printing a prescription information on the packaging paper; and b) a release conveyer for externally releasing a series of paper bags in accordance with the tablet-packaged and information-printed paper.

4. The automatic tablet dispenser as described in claim 1 wherein the heater assembly seals a batch of tablets in the packaging paper, wherein the batch of tablets are the tablets temporarily gathered by the release door in the discharge hopper and downwardly released by the swing-down (opening) operation of the release door.

5. An automatic tablet dispenser controlled by a main computer comprising:

a) a tablet dropping unit having a drum communicating with a plurality of release holes which fixate a plurality of tablet storing tablet cassettes, said release holes dropping the tablets released from the tablet cassettes;

b) a discharge hopper having a release port provided through a lower portion of said discharge hopper, and a tablet release door for swinging down to open and swinging up to close the release port, wherein the tablets released from the tablet dropping unit are temporarily gathered in the tablet release hopper when the release door is closed, wherein the discharge hopper is formed of a front panel having a lower front panel line, a rear panel having a lower rear panel line, and a pair of side panels each having a lower side panel line, wherein said each panel line defines the release port through the lower portion of said discharge hopper, wherein the release door is hingedly engaged to the lower front panel line, wherein the lower front panel line is formed higher in horizontal level than the lower rear panel line, whereby the swinging operation of the release door can be smoothly implemented with less momentum;

c) a door control for elastically controlling the swinging of the release door of the discharge hopper;

d) a heater assembly for packaging the tablets from the discharge hopper in a packaging paper; and e) a motor driving the door control and the heater assembly.

6. The automatic tablet dispenser as described in claim 5 wherein said door control comprises:

a) a hinge connecting the release door to the lower front panel line of the discharge hopper to enable the swinging of the release door thereon;

b) a spring engaged to the hinge for providing an elasticity to the swing-up (closing) operation of the release door;

c) a hinge control bendingly extending from the hinge;

d) a rotation shaft driven by the motor;

e) a cam carried on said rotation shaft;

f) a connecting member having a cam lever making an angular movement by said cam and a hinge link abutting over on the hinge control to produce the swing-down (opening) operation of the release door in accordance with the angular movement of the cam lever, whereby the tablets gathered in said discharge hopper at the swing-up operation of the release door are simultaneously dropped into a target packaging paper by the swing-down operation of the release door.

7. The automatic tablet dispenser as described in claim 5 further comprising:

a) a printer for printing a prescription information on the packaging paper; and b) a release conveyer for externally releasing a series of paper bags in accordance with the tablet-packaged and information-printed paper.

8. The automatic tablet dispenser as described in claim 5 wherein the heater assembly seals a batch of tablets in the packaging paper, wherein the batch of tablets are the tablets temporarily gathered by the release door in the discharge hopper and downwardly released by the swing-down (opening) operation of the release door.

9. The automatic tablet dispenser as described in claim 5 wherein the angle defined by the front panel of the discharge hopper and the release door is between about 120 degrees and about 170 degrees.

10. The automatic tablet dispenser as described in claim 9 wherein the angle defined by the front panel of the discharge hopper and the release door is about 150 degrees.

* * * * *